US007347886B2

(12) United States Patent
Ickinger

(10) Patent No.: US 7,347,886 B2
(45) **Date of Patent: *Mar. 25, 2008**

(54) METHOD FOR INTRODUCING ADDITIVES INTO FLUIDS

(75) Inventor: Georg Michael Ickinger, Graz (AT)

(73) Assignee: Sulzer Chemtech AG, Wintherthur (CH)

( * ) Notice: Subject to any disclaimer, the term of this patent is extended or adjusted under 35 U.S.C. 154(b) by 0 days.

This patent is subject to a terminal disclaimer.

(21) Appl. No.: 11/491,222

(22) Filed: Jul. 21, 2006

(65) Prior Publication Data

US 2006/0272702 A1 Dec. 7, 2006

Related U.S. Application Data

(62) Division of application No. 10/958,855, filed on Oct. 5, 2004, which is a division of application No. 09/936,039, filed on Sep. 8, 2001, now Pat. No. 6,866,171.

(30) Foreign Application Priority Data

| | | |
|---|---|---|
| Jan. 10, 2000 | (AT) | 19/2000 |
| Jun. 7, 2000 | (AT) | 995/2000 |
| Aug. 28, 2000 | (AT) | 1475/2000 |
| Apr. 1, 2001 | (AT) | PCT/AT01/00003 |

(51) Int. Cl.
*C22B 21/04* (2006.01)
*C21C 7/00* (2006.01)

(52) U.S. Cl. ..... 75/684; 266/216

(58) Field of Classification Search ..... 266/216; 75/684

See application file for complete search history.

(56) References Cited

U.S. PATENT DOCUMENTS

| | | | | |
|---|---|---|---|---|
| 4,474,717 | A * | 10/1984 | Hendry | 264/45.5 |
| 5,129,629 | A * | 7/1992 | Christensen | 266/216 |
| 6,866,171 | B2 * | 3/2005 | Ickinger | 222/596 |
| 2005/0077642 | A1 * | 4/2005 | Ickinger | 264/51 |
| 2006/0254389 | A1 * | 11/2006 | Ickinger | 75/684 |

* cited by examiner

*Primary Examiner*—Scott Kastler
(74) *Attorney, Agent, or Firm*—Francis C. Hand; Carella, Byrne, Bain et al.

(57) ABSTRACT

The method introduces additives into flowing gas, fluid or fluidized media in a pulsed high pressure manner. The nozzle needle of at least one nozzle is variable and highly precisely moved for the introduction by means of a device and in such a way that additive is dosed exactly in relation to the volume flow of the medium. The pulsating additive stream is injected into the flowing medium by at least one well-aimed nozzle opening. The additives are dosed by means of a pressure that can be variably adjusted by pulse width and pulse frequency. The desired homogenous distribution is obtained by the penetrating injection jet.

10 Claims, 19 Drawing Sheets

METHOD FOR INTRODUCING ADDITIVES INTO FLUIDS

This application is a Division of Ser. No. 10/958,855, filed Oct. 5, 2004 which is a Division of Ser. No. 09/936,039, filed Sep. 8, 2001, now U.S. Pat. No. 6,866,171.

The invention relates generally to a method for introducing additives into flowing fluids such as a gas and a liquid with specific applications.

BACKGROUND

U.S. Pat. No. 4,474,717 describes an injection of a small portion of plastics without introducing inert gas (preloading) followed by sectional introduction of inert gas using frequencies from 4 to 100 cycle per second having a pressure of 300-1500 psi (2 to 10 MPa) into the continuous passing plastic material. The result is a multi-layered internal foamed structure. The present invention expands this method by applying injection technology used in the combustion engine technology and reaching a more intensive penetration by higher pressure (40 to 200 MPa), higher frequency (100 to 1000 hz) and more exact dosing by controlled width of the pulses, frequency of the pulses and regulation of pressure using this technology.

The pulsing adding of liquid and gas is state of the art in burner systems, airless jet systems and spraying systems (atomizers). The present invention is demarcating from these application by higher pressure of the liquid than 40 MPa and high energetic atomizing. This pressure is not possible with the nozzles used at this time. Only by electrical activated hydraulic servo valves in common rail technology can these pulsation be realized.

SUMMARY OF THE INVENTION

The basic concept of the method for introducing additives consists of obtaining intensive atomizing, mixing and deep penetrating of additives into the medium stream by using high kinetic energy of the additives and exact timed pulsing and exact pulse width using appropriate injectors.

The exact dosing of the additives is obtained by regulation of the operation parameters of introduction for instance pressure, frequency, pulsing width, etc.

The state of the art of combustion engines using the "common rail" injection technology is utilized. The flexibility of this system by modifying the operating parameters is the highlight of this technology in comparison to the present mechanical operated injection methods because there is injection nozzle, etc. The common rail is loaded with fuel being pressurized up to 200 MPa and supplies the injector with this constant pressure. Electronic controller activating solenoid and piezo-operated, electro-hydraulic servo-valves move the nozzle needle by push rods with high precision. According to this technology exact dosing and homogenous distribution will be obtained.

The application and further development of this injection technology is subject to utilizing this improved technology for further applications as mentioned before. Furthermore detailed design and configuring of nozzles, nozzle-needles, the arrangement of orifices in position and shape as well as arrangement of injectors are aspects of this invention.

The invention is particularly directed to the following applications:

metal melts (e.g. metal injection molding)
hard metal sintering
foaming of aluminum introduction of additives in pelletizing plants
cellulose applications
fuel introduction for burner applications
color spraying The introduction and dosing and the homogenous distribution of bleaching agents, solvents in circuits of cellulose, pulp and mechanical wood pulp occurs according to the state of art by dosing units with subsequent mixing. High shear forces are needed for the efficient mixing. Further, any modification of the operation parameters (because there is a change in the amount of additives or changing of color chemical additives) will have an immediate effect.

The following application, processes and devices can be economically realized with the invention:

- Introducing, dosing and homogenous distribution of catalyzers, reactants in flowing liquid in chemical, processing systems as well as, for instance, distillation water treatment, refinery systems.
- Introducing, dosing and homogenous distribution of blowing agents, solvents into the circuit of pulp and ground wood systems.
- introducing, dosing and homogenous distribution (Aerosol) of fuel into combustion systems into the flowing (gas) stream.
- introducing, dosing and homogenous distribution (Aerosol) of dyes and solvents in airless and spraying systems into the flowing (gas) stream.

The injection technology of combustion engineering has reached a high state of art concerning the exact repeatability due to the demands of strict exhaust specifications and is especially applicable to the invention. The state of the art is shown by "fuel-injection valves for internal combustion engines" disclosed in DE2028442, 1970, by DAIMLER BENZ. The hydraulic activation of the valve push rod is regulated by a three-way valve. An "injection device" with hydroelectric activation was invented by PEUQUEOT, FR2145081, in 1971. The valve is pushed by a continuous hydraulic pressure and released by a controlled pressure loss on the backside of the push rod. In US3990422, 1973, by BENDIX CORP, the control of the hydroelectric activation has been improved by using a two circuit hydraulic system.

The present injectors show features which are necessary to comply with the demands of the inventive application and specification thereof. These are pressure regulation, Electro-hydraulic activation by a push rod valve and pressure controlled by a sphere valve at the high pressure circuit, which is necessary to reach the high frequency pulsation and have the high pressure available at the nozzle needle immediately at the valve seat by a common rail system. The high pressure for injectors in combustion engines is needed for atomizing and distribution of the fuel in the combustion zone. The high pressure for injectors in melt introduction processes is needed to overcome the high melt pressure of about 100 to 140 MPa. Pressure of about 200 MPa can be reached by the available injectors with common rail. The continuous supply and the activation of the valves are solved with high reliability today.

An essential presupposition for running the injectors is the lubrication by the fuel because substances (water, alcohol, liquid gas) do not have substantial lubrication effect. The basic idea of the present invention is the use of two circuits applied to the standard injectors available in the market for making additional measures.

JP 8170569 shows a version of injectors for diesel engines using a high pressurized circuit for injection and a low pressurized circuit for a servo-hydraulic system. The injector operates by separation of the hydro-electrical activation of the push rod of the valve which uses standard hydraulic oil and the introduction of gas creating substances that occurs at a slightly lower pressure (different than JP 8170569) because of a non-return lock pressure that prevents penetration of the melt into the injector. Only the needle and seat of the valve are in touch with the non-lubricating medium. These parts can be made of sintered highly wear resistant material and are easily changeable. The electro-hydraulic servo circuit is not effected because of the separate circuit.

Further alternative solutions for the injector are:

1) Pump nozzle system with a combination of high pressure piston and spherical valves.

2) An electric activated swing system attached to a pump piston.

3) Limits for the stroke and positioning of the inlet valve as known for airless spraying systems can be used as well. In some applications, it is an advantage to have a small pressure difference between the introduced material and the melt. For this, the above solution can be used.

The regulation and control of the introduction process has the following features. Optionally, the hydraulic circuit can be separated from the gas creating substances to be introduced. The pressure $p_1$ of the medium to be introduced and the pressure $p_2$ of the hydraulic system are regulated by a pressure limit valve. The controller regulating the pressure depends on the melt $p_3$, for the hydraulic system circuit as well as the injection pressure of the introduced medium. The injector is activated by a solenoid or piezo actuator. The regulation is controlled by an "Arbitrary Wave Form Generator", known to those skilled in the art. Furthermore, the specification of hydraulic, nozzles, injectors and melt channel are described below.

The hydraulic system of existing machines have usually a pressure of 26 MPa that can be used to produce high pressure by a pressure multiplying system. In order to achieve this feature, an exact pressure regulation with electrical pressure limit and a precise activation of the hydro-electric valves is necessary. The shaping of the valve, valve seat and the smooth configuration of the melt channel according to hydrodynamic principles is important for repeatable dosage. The injectors of the "common rail technology" have the capability to fulfill these features.

The regulation of the solenoid takes place by controlling with "Arbitrary Wave Form Generator", opening and locking can be optimized by this system.

The invention also relates to a multifunctional mixing and dosing head, consisting of a nozzle cone and a nozzle needle, in which the volume flow is metered or blocking the outside flowing medium by the position of the outside nozzle needle and consisting of a nozzle cone and a nozzle needle, in which the volume flow is metered or blocks the inside flowing medium by the position of the inside nozzle needle.

This combination of valve, nozzle and injector leads to an economical mixing and dosing directly on the needle top of the concentric double cone. The invention also relates to a hot runner valve, having an injector, for introducing the additives into the outer flowing medium, instead of the valve needle. Several combinations of mixing and dosing heads are mentioned and the subsequent attachment of static mixer systems.

The economical benefit consists of the spatially predetermined location of the dosage and the excellent mixing and the exact dosing according to the mixing ratio. Applications for this hot runner valve with integrated mixing head includes introducing additives into the flowing media. Besides the several known two component hot runner valves, the present suggested solution has the following features:

The application of the concentric positioned nozzle needles within the nozzle needle of this invention can be compared to EP 0310 914, where a concentric positioned nozzle needle is shown. The present apparatus is distinguished from the above by using a spatially predetermined dosing of the melt while in EP 0310914 only each of the two media is switched to the mould. The present apparatus can achieve any mixing ratio in between by using the introduction of the additives by pulsation.

An object of the present invention is not only to introduce at least two media in a concentric manner, but also to achieve a mixing, i.e., a dosage of the external medium with the internal medium.

BRIEF DESCRIPTION OF THE DRAWINGS

The invention may take form in certain parts and arrangement of parts, preferred embodiments of which will be described in detail and illustrated in the accompanying drawings which form a part hereof and wherein:

FIGS. 40*a*, 40*b*, 40*c* and 40*d* illustrate various aerosol profile shapes capable of being produced by the subject invention;

DETAILED DESCRIPTION OF THE INVENTION

Figure 1:
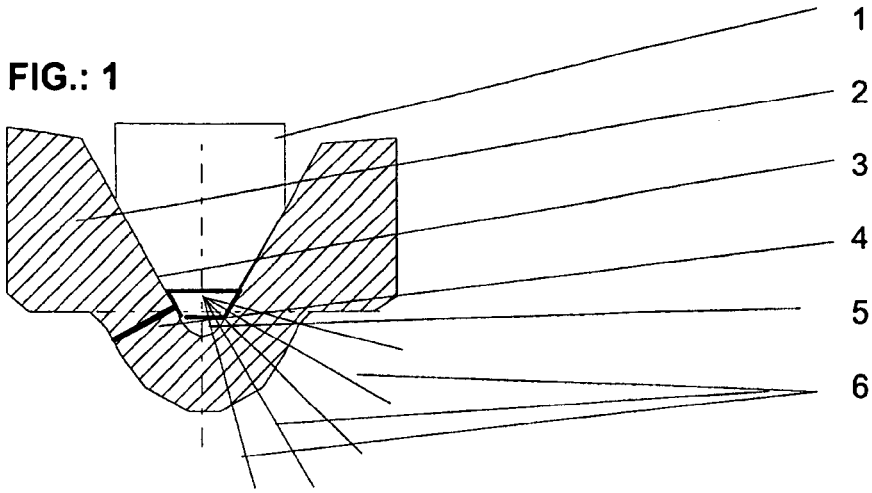
FIG. 1 is a schematic sectioned view of a valve cone orifice nozzle tip in accordance with the invention.
Figure 2:
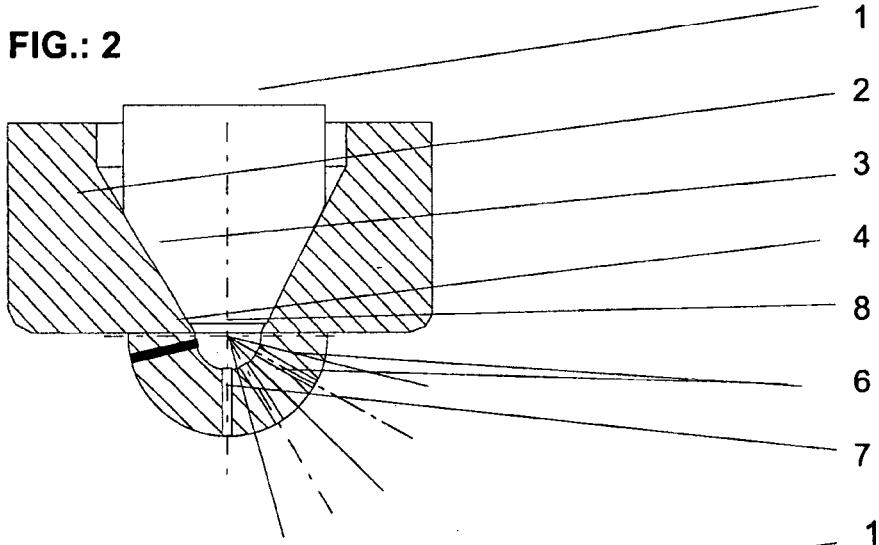
FIG. 2 is a sectioned view similar to FIG. 1 illustrating a pocket hole orifice.

Referring now to the drawings wherein the showings are for the purpose of illustrating preferred embodiments of the invention and not for the purpose of limiting the same, there is shown in FIGS. 1 and 2 nozzles, nozzle needles and nozzle seats. The subsequent FIGS. 3 through 17 show samples for the application of the present method of introduction with exact dosing and homogenous distribution.

FIG. 1 shows a valve cone orifice, "VCO" nozzle tip wherein the nozzle needle 1 that closes the needle seat 3 is located in the nozzle body 2. The small volume of the front chamber 5 is the target of the VCO. The orifices 4 are inclined about 80° to the axis as used in combustion engines. Other orifices 6 shown on the right hand side of the axis have stepwise inclinations of 0° to 75° inclined to the axis.

In FIG. 2, a pocket hole orifice is shown. The larger front chamber 8 of the nozzle gives a larger volume of free drops, by means an inexact dosing. The larger chamber gives the possibility of several radial arranged orifices 6 as well as an axial positioned orifice 7.

Figure 3:
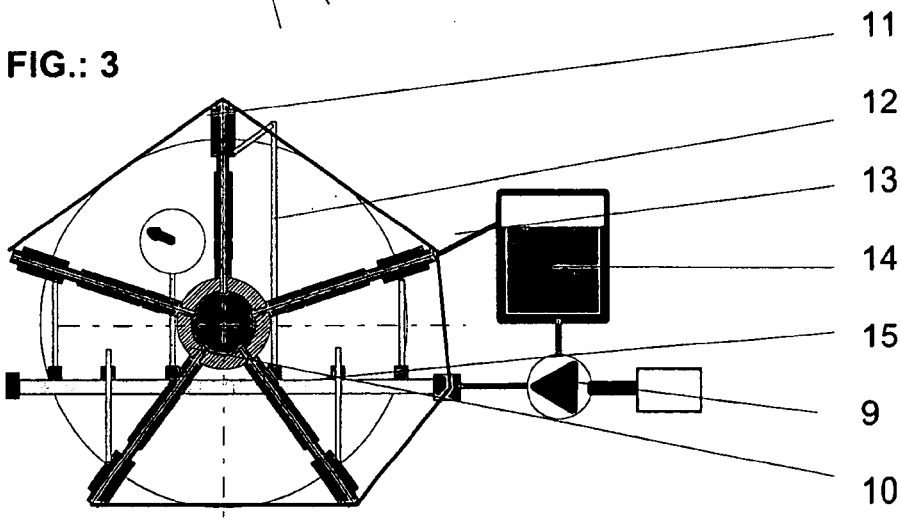
FIG. 3 is an elevation schematic view of a dosing and mixing arrangement.

In FIG. 3, an arrangement of a dosing and mixing arrangement for a flowing medium in a tube 10 is shown with five injectors 11 reaching into the tube 10. The injectors 11 are connected to a high pressure pipeline 12 containing the additive. The tank 14, the high pressure pump 9, the common rail 15 and the leakage pipe 13 are shown.

Figure 4:
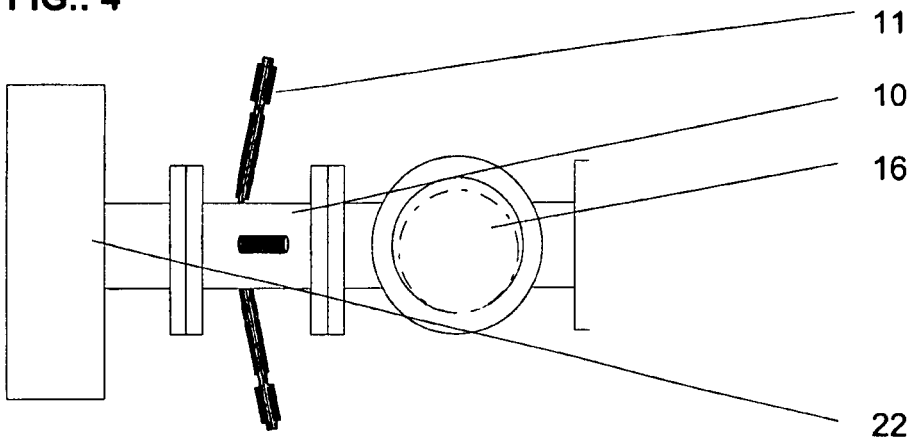
FIG. 4 is a top view of the schematic arrangement illustrated in FIG. 3.

In FIG. 4, an arrangement of FIG. 3 is shown from the top view for an aerosol system.

Figure 5:
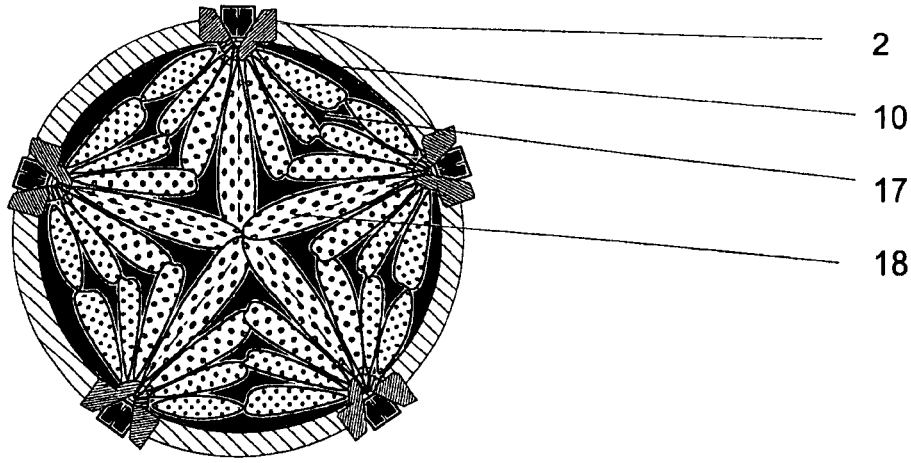
FIG. 5 is a schematic cross-sectioned view of a tube shown in FIG. 3.

FIG. 5 shows a sectional view of the tube 10 which is enlarged. The five nozzle bodies 2 are arranged in a radial 72° pattern. Each nozzle body 2 has 7 orifices positioned in an angle of 75°, 50°, 25° and 0°, etc. The jet of the injection 18 gives a complete covering of the section of the medium 17. The length of the jet stream is determined by the diameter of the orifice and is usual between 0.11 mm and 0.14 mm.

Figure 6:
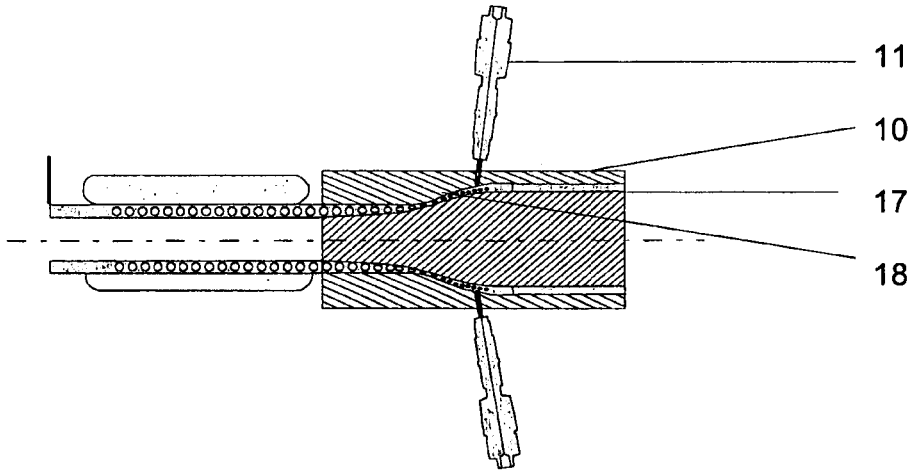
FIG. 6 is a schematically sectioned plan view of a nozzle for producing a cylindrical profile.

FIG. 6 shows a channel of a flowing medium producing a cylindrical profile. Two of the several arranged injectors 11 are shown in the section. The additives 18 are introduced according to the velocity of the medium 17 in the flow direction.

Figure 7:
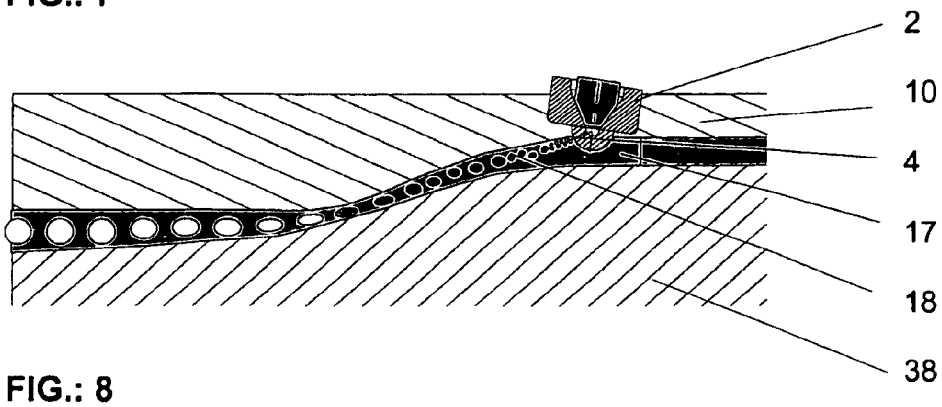
FIG. 7 is an enlarged schematically sectioned view of one of the nozzles illustrated in FIG. 6.

In FIG. 7, the detail of the nozzle arrangement is shown. The nozzle bodies 2 have at least one orifice 4 in the direction of the flowing medium channel. The jet stream, not the wall sides 10, is directed to bring the additives 18 into the core 38 of the stream.

Figure 8:
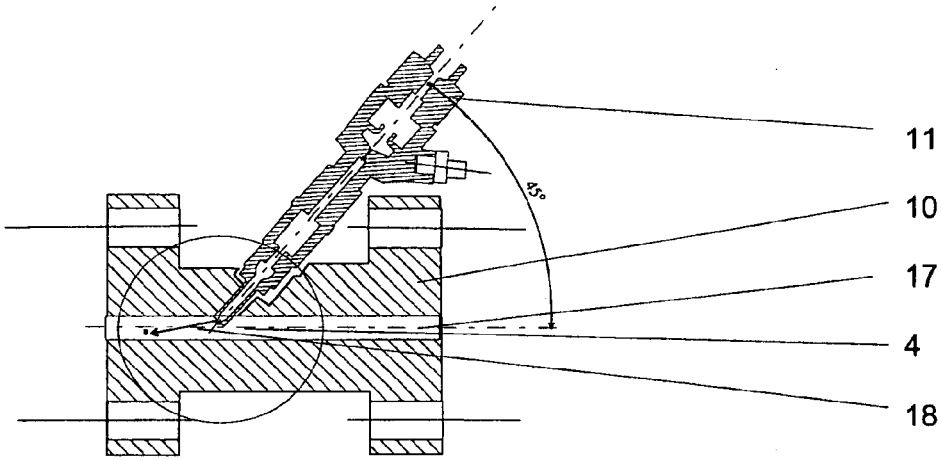
FIG. 8 is a schematic sectioned plan view of an injector fitted to a tube.
Figure 9:
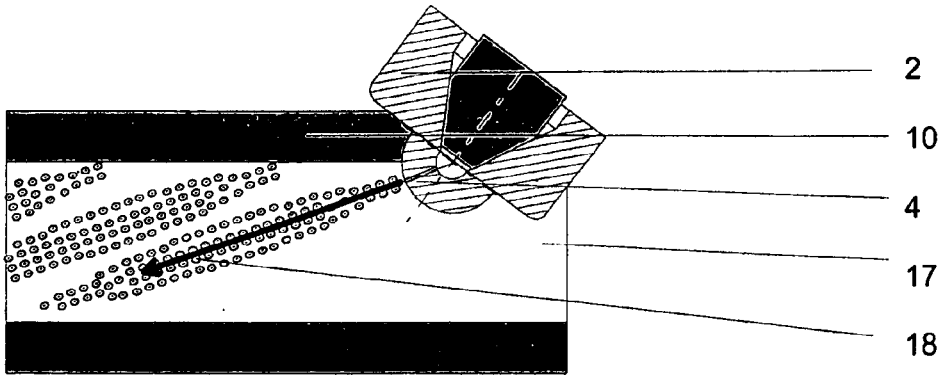
FIG. 9 is an enlarged view of the injection nozzle/tube arrangement illustrated in FIG. 8 showing cascade distribution of the injection.

In FIG. 8, an application for a single injector is arranged which is inclined about 45° to the tube axis 10. The orifice 4 is inclined in a flat slope angle to the medium flow i.e. the orifice is positioned about 40° out of the axis of the injector. The pulsing introduction is giving a cascade distribution shown in FIG. 9.

Figure 10:
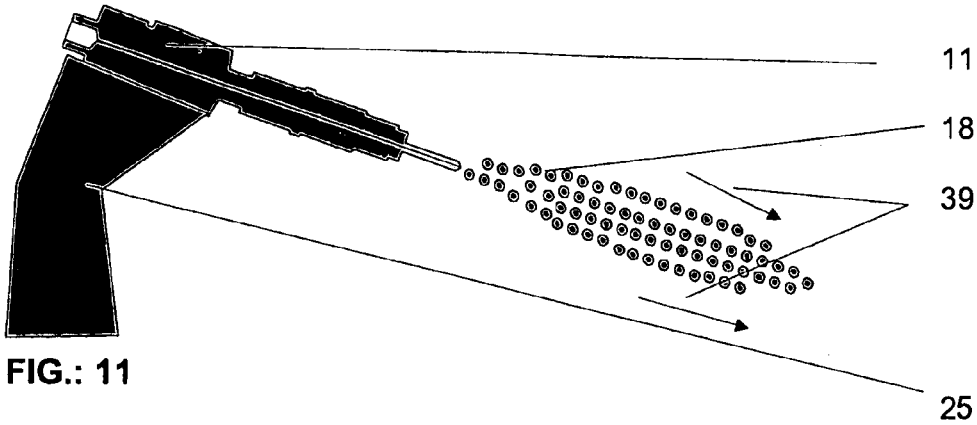
FIGS. 10 and 11 are schematic representations indicating the nozzle flow pattern.

FIG. 10 shows an airless jet stream 25. The flowing medium 39 is the streaming side air. The additive is dyes 18. The pulsation determines the coloring conditions.

Figure 11:
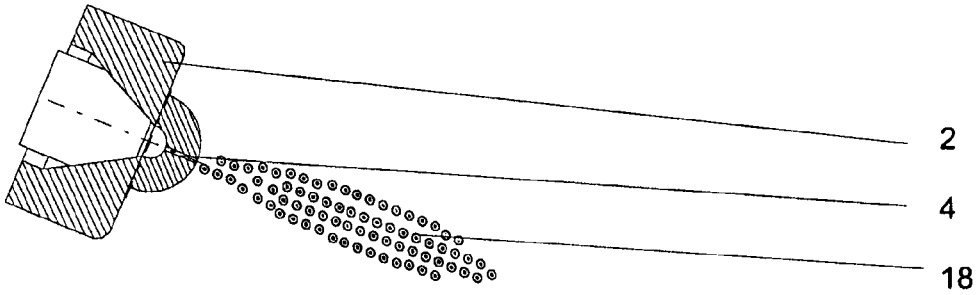

The nozzle arrangement is shown in FIG. 11. At least one orifice 4 in the nozzle body 2 is directed near the axis and determines the spraying structure or pattern 18.

Figure 12:
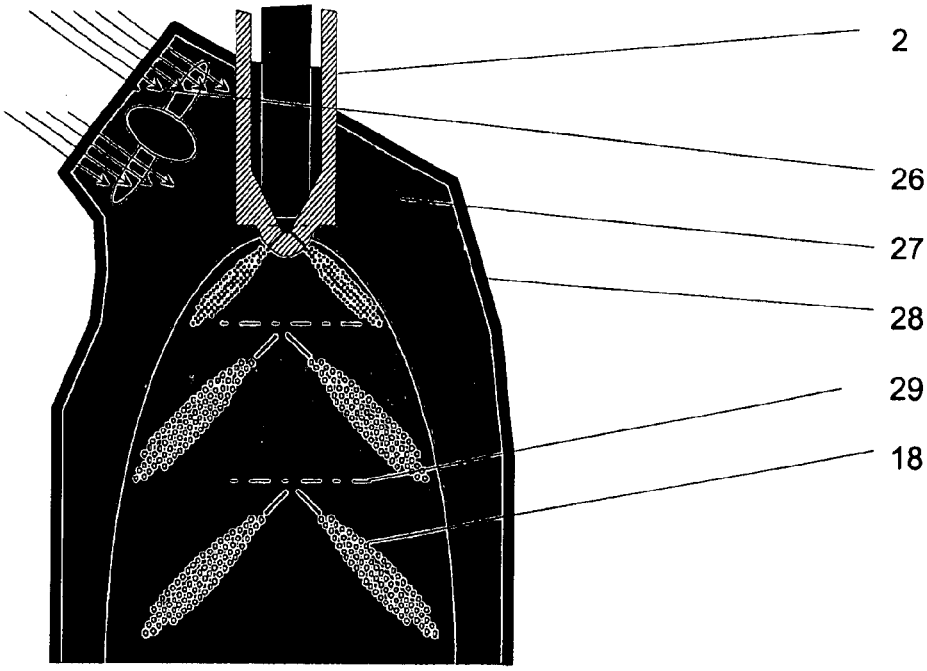
FIG. 12 is a schematic representation of a dosing and mixing arrangement for a combustion system.

FIG. 12 shows the dosing and mixing arrangement for a combustion system. The nozzle body 2 extends into the combustion chamber 27 and is limited by the casing 28 of the burner zone. The combustion air is compressed by a blower 26 in the casing 28 and the atomizing of the fuel uses the standard arrangement of orifices located on a cone. The injection jet stream 18 results in accurate dosing and mixing of the perfect combustion 29.

Figure 13:
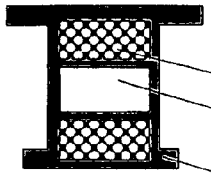
FIG. 13 is a schematic representation of a channel for flowing medium
Figure 14:
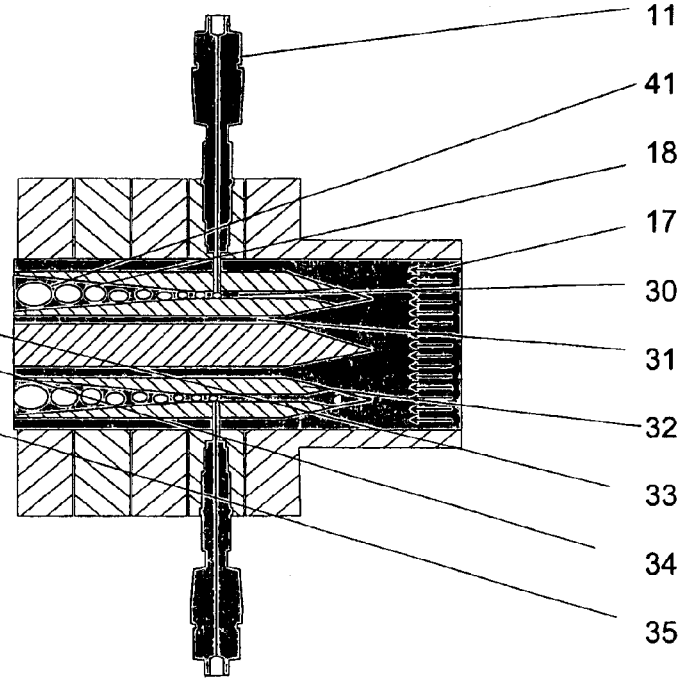
FIG. 14 is an orthogonal representation of the channel for flowing medium depicted in FIG. 13.

FIGS. 13 and 14 illustrate the application of a channel for flowing medium. The dosing and mixing have the purpose of modifying material diverted from the main stream. The section shape is shown in FIG. 14. The injector 11 extends into the side channel 30. The different material streams 31 are separated by inlet channels, i.e. calipers 32. The medium stream 17 is injected with additives 18 to create a modified material in the side stream which is transported to the chambers 33 and 34. Chambers with solid calipers creating hollow profile space is usual.

Figure 15:
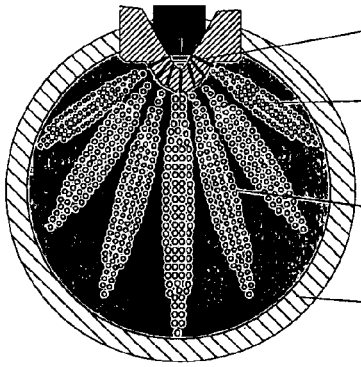
FIGS. 15 and 16 are views similar to FIGS. 13 and 14 respectively.
Figure 16:
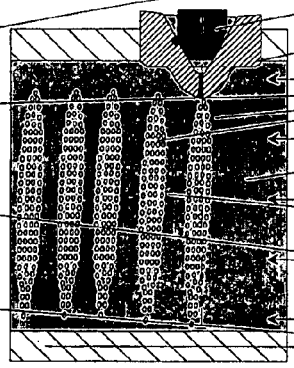

In FIGS. 15 and 16, the introduction of additives 18 by pulsation into the side channel is shown. FIG. 15 shows the tube section 30 and the single tube 10. FIG. 16 shows the lateral section of the tube 30/10. The nozzle body 2 has 7 radial arranged orifices 4 and gives full coverage of the material section 17 by the jet streams 18 for dosing and mixing. A sequence of several jet streams 36 respectively 37 introduced in flow direction are shown in FIG. 16.

Figure 17:
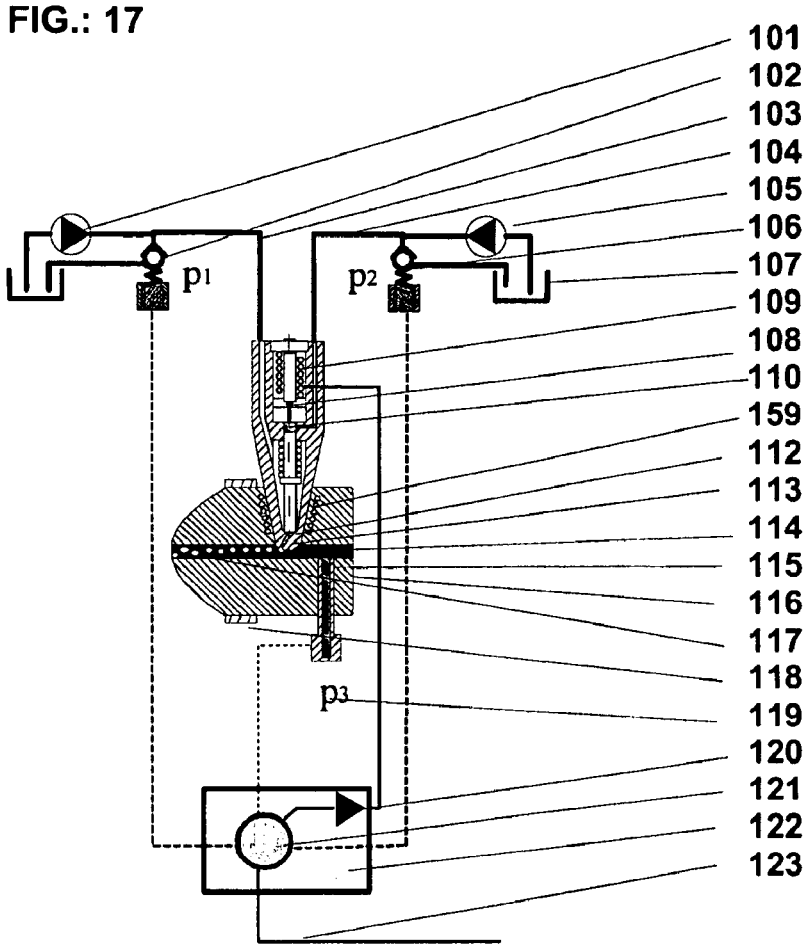
FIG. 17 is a schematic operating diagram for standard injectors used in the present invention.

In FIG. 17, the total apparatus for injectors of standard design is given in the layout. The utilization of pumps 101 and 105 enable the application to be used in a continuous operation. The circuit for the additives 103 is separated from the circuit of the hydraulic oil of the servo 104. The pressure of the circuits is regulated by an electrically activated presser limit valve 102,106. The valve 112 is released by electro-hydraulic mechanics. The mechanics consists of a solenoid 109, a spherical valve 108 and the push rod connected to the high pressure piston 110. The controller 122 regulates the electro-hydraulic mechanics according to the information 120 given by the operation data as there is injection time/extrusion data 123 according to the pressure sensor in the melt 114 of the pressure of the additive circuit 102 and the pressure of the hydraulic oil of the servo 106.

The arbitrary wave form generator 120 creates the opening current for the electro mechanism 112. The introduction of the gas processors 117 into the melt stream 114 happens in the interface 116 part after the extruder tip 160 via a nozzle 113 extending into the channel. For heating, a heater band 159 is located around the nozzle 113.

Figure 18:
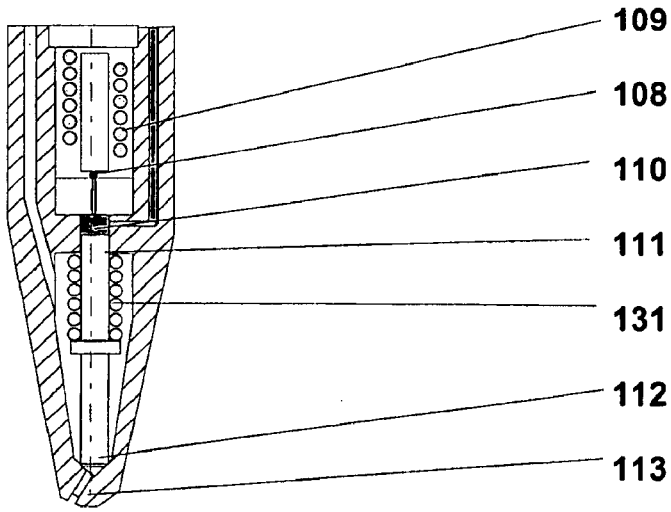
FIG. 18 is a schematic cross-sectional elevation view of a standard conventional injector shown with a pocket hole valve.

FIG. 18 shows a standard injector. This version shows a pocket hole valve 113 with a small front chamber. The valve seat 112 isolates the nozzle from the continuous pressurized circuit.

The push spring 131 increases the force resulting from the difference of force on the nozzle needle 112 and the hydraulic pressing (bias) 110. The opening is activated by the solenoid 109 which releases the sphere of the valve 108 and hydraulic oil of the servo is able to stream out of the high pressure chamber 110.

Figure 19:
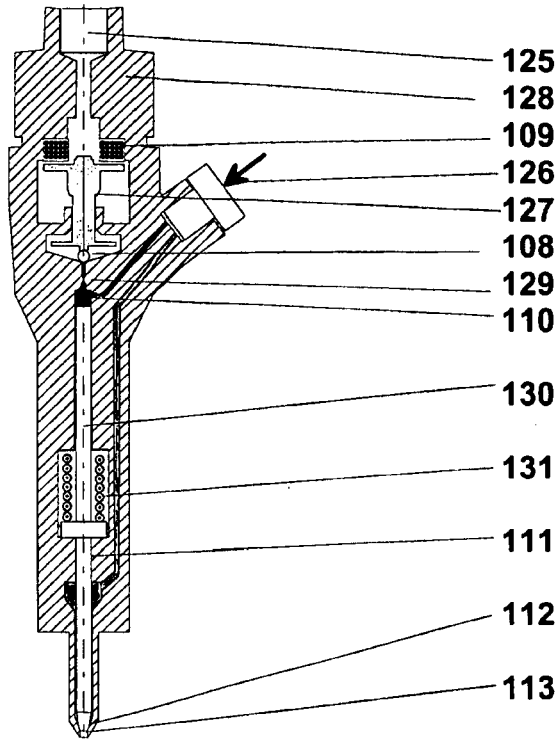
FIG. 19 is a schematic elevation view of a prior art injector.

FIG. 19 shows an injector of the state of art. The essential features can be readily recognized. The version with the electro-hydraulic activation is extended by throttle 129 and anchor 127 and double chamber. Standard Injectors having separate inlets 126 for the servo supply and the injection supply.

Figure 20:
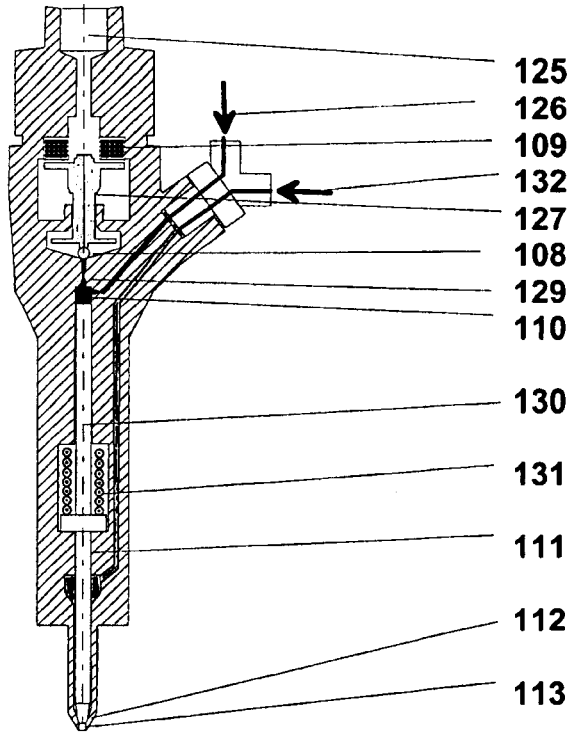
FIGS. 20 and 21 are views similar to FIG. 19 showing modifications to the injector in accordance with the invention.

FIG. 20 shows a section of a modification of a standard "common rail injector". The already available two supply borings are attached to a special fitting.

Figure 21:
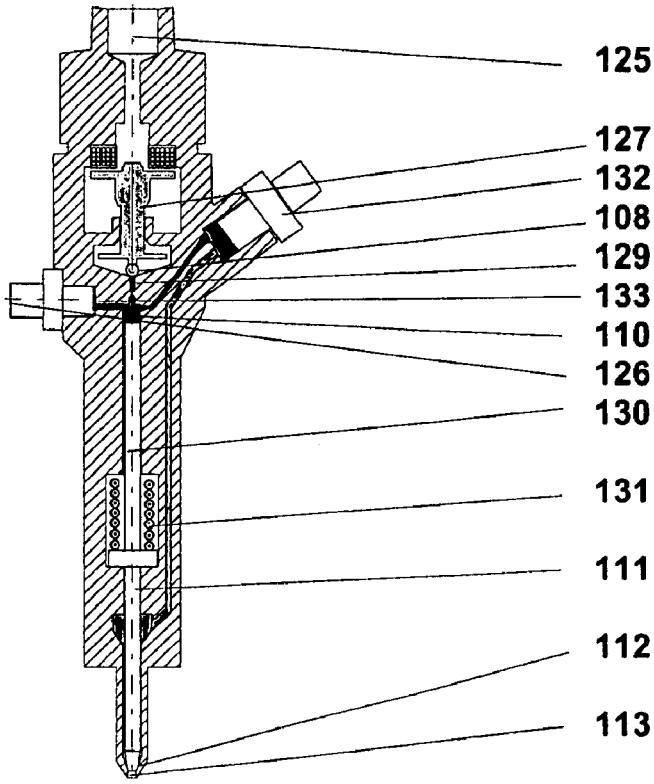

FIG. 21 shows the modification of a standard "common rail injector" with a second boring. The supply 132 of the hydraulic servo circuit is blocked by a pin. Additional supply is given by a boring 133 and a second fitting 126 for the servo circuit.

Figure 22:
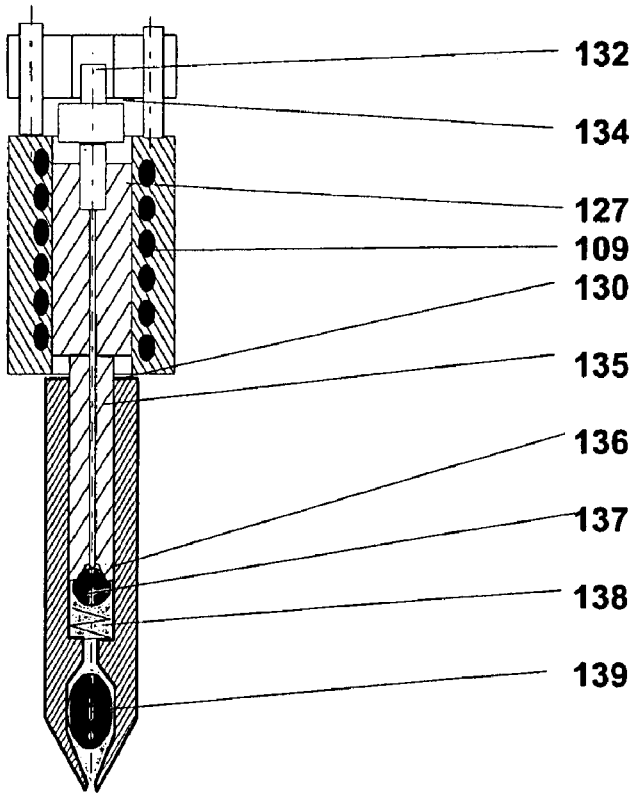
FIG. 22 is a schematic elevation view showing a pump nozzle configuration.

FIG. 22 shows a pump-nozzle configuration in principle, by means of the high pressure chamber being close to the location of the nozzle. The medium of the additive is supplied through a boring in the push rod 135 and the pressurizing is effected by an inlet valve 137 and an outlet-valve 139. The penetration of the melt into the injector is prevented by a sphere 137 which is pressed by a non-return-spring 138 into the valve seat. The push rod 135 is activated by a magnetic swing system 127. By stroke limit 134 the size of the pulsation is determined. The line for leakage 140 returns the overflowing medium.

Figure 23:
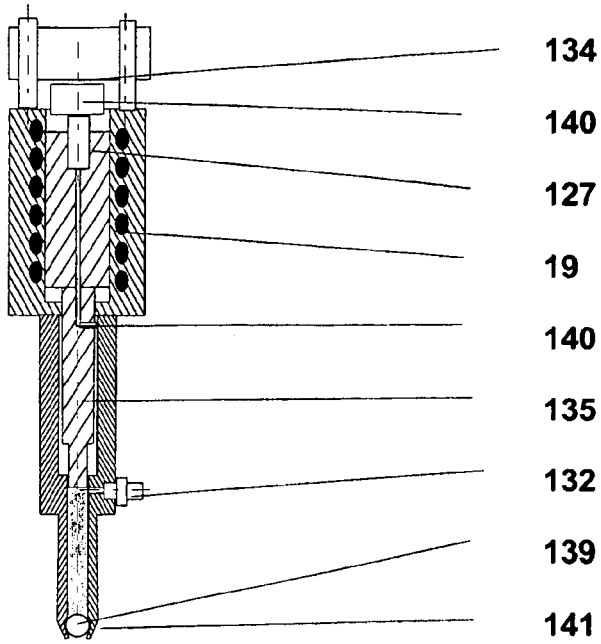
FIG. 23 is a view similar to FIG. 22 illustrating an airless spraying system.

FIG. 23 shows the principle of an airless spraying state of the art system, applied to the present application by using a valve sphere 139 within the nozzle. The advantage of a small front chamber can be reached by a overlapping 141 of the sphere valve 134,135,140 as shown in FIG. 22.

Figure 24:
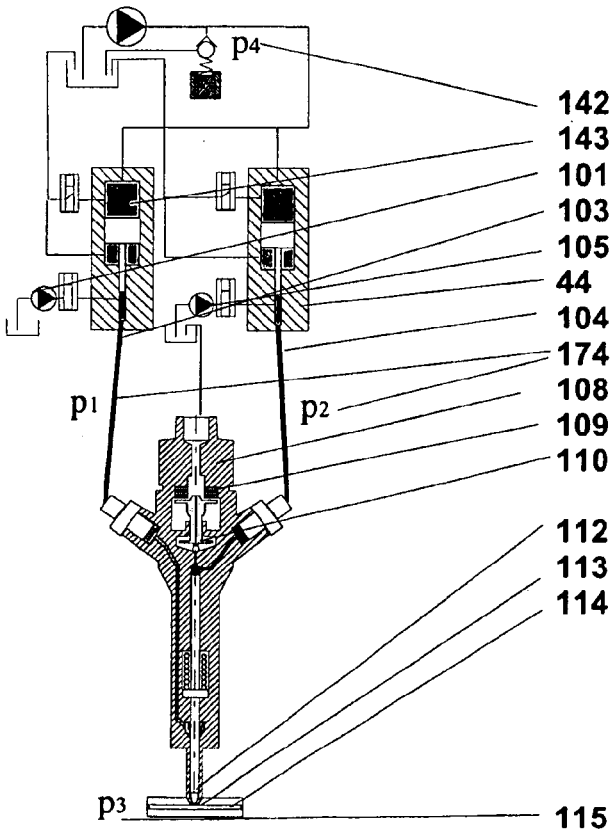
FIG. 24 is a hydraulic circuit representation.
Figure 25:
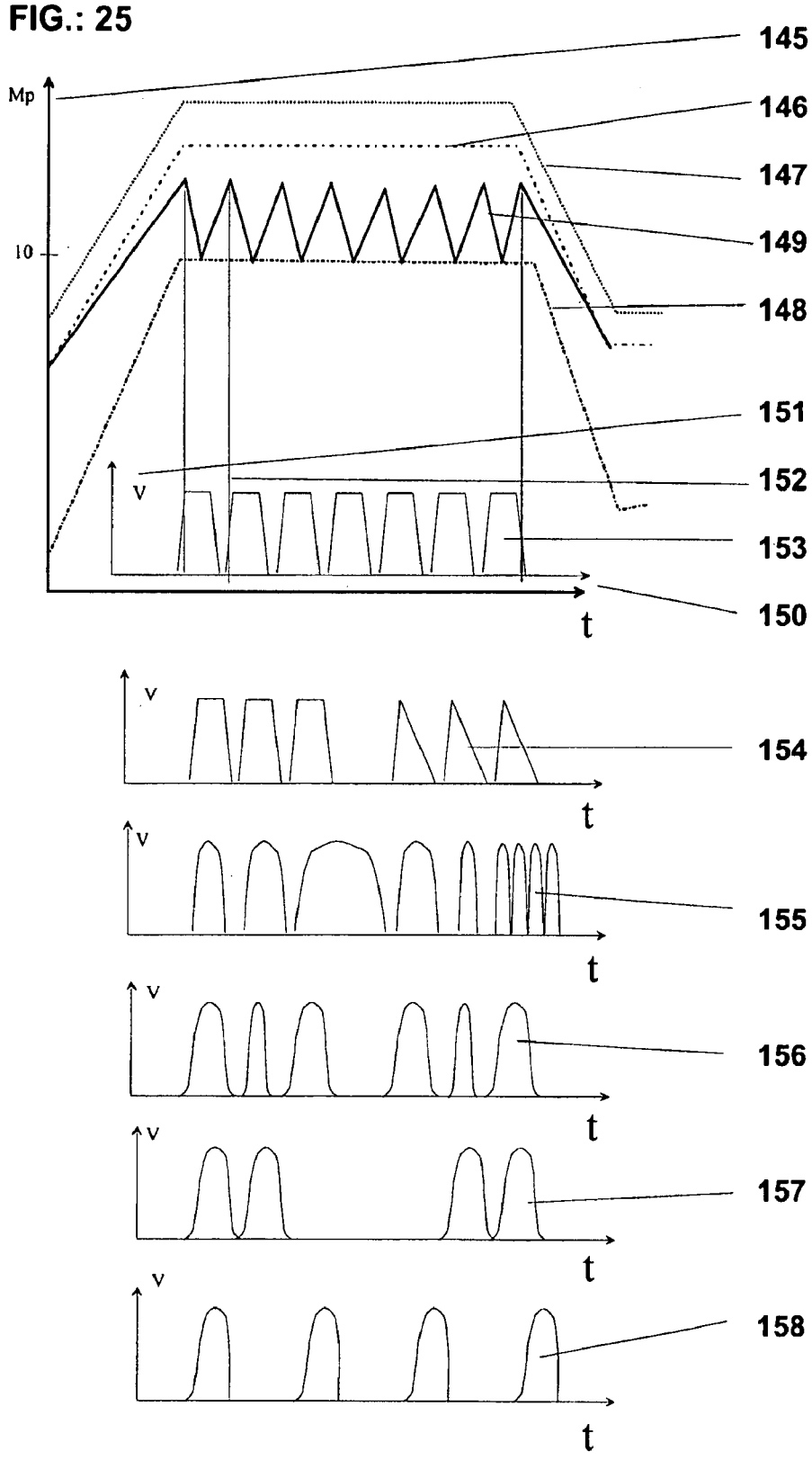
FIG. 25 is a graph showing melt pressure traces as a function of time.

FIG. 24 shows a hydraulic system for part production for instance for injection systems. The operation of the injector is having a twin circuit system. The pressure multiplier is connected to the basic hydraulic system of the machine 142. While processing the part there is time to load the system for injection. The pressure multiplier cylinder for the additive 143 and for the servo hydraulic oil 144 are pressurized and being regulated by the pressure limit valve 142 during the injection having the pressure $p_4$. Subsequently, the chambers of the cylinders are refilled by pumps 101 for the additive and pumps 105 for the hydraulic oil.

Figure 26:
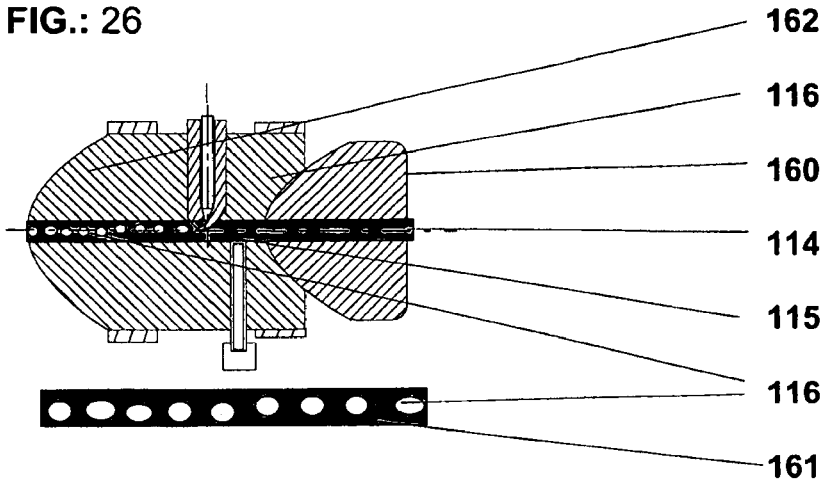
FIGS. 26, 27 and 28 are schematic representations of various flowing media channels used with the invention.

FIG. 26 shows the features of the pressure ramping y-axis in MPa 145 over the duration for the present processing. The medium pressure $p_3$ is shown by the curve 148. The pressure of the additive $p_1$ is shown by curve 146, the pressure of the servo hydraulic $p_2$ shown with the line 147. The electric potential 153 to activate the electro-hydraulic regulation is shown by the curve 149. Various wave forms can be produced and are shown by way of example as triangle 154, half sinus waves 155 at different frequencies and full sinus wave form 156 with different frequencies and phases or full sinus form 157 in different frequency or different phases 158 as well as unsymmetrical wave forms, all being produced by an arbitrary wave form generator.

Figure 27:
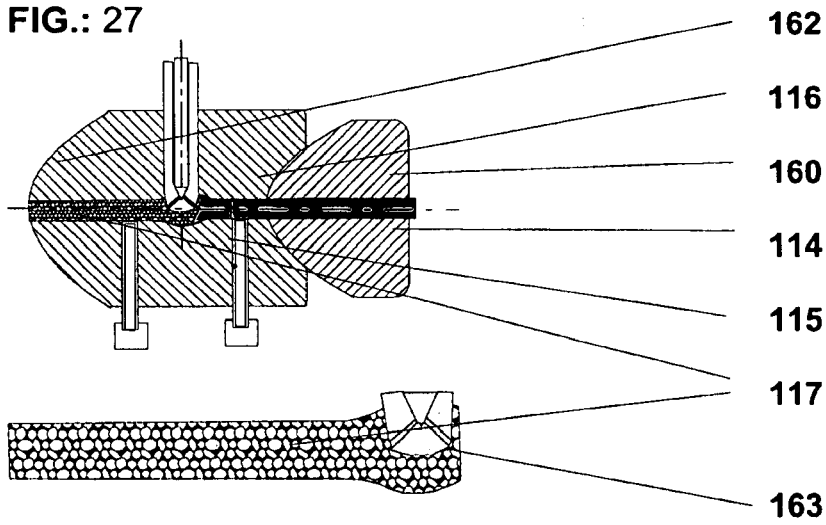
Figure 28:
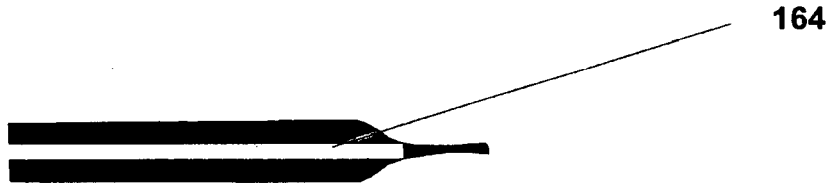
Figure 29:
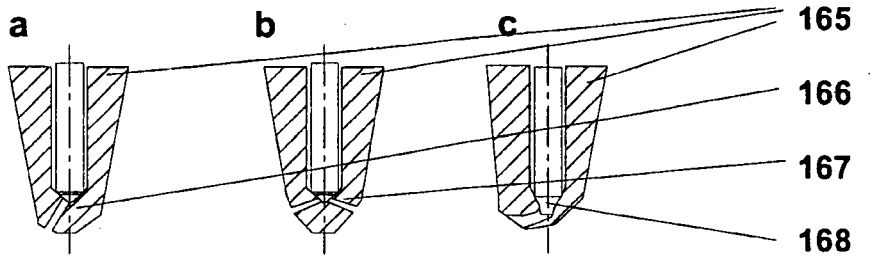
FIG. 29 is a depiction of several different nozzles designated "a", "b", "c", capable of being used with the invention.

FIGS. 27, 28 and 29 show several medium channels. FIG. 27 shows a parallel medium channel 114 in flow direction positioned orifice having an interface part 116 between mould 162 and nozzle tip 160 of the barrel. This arrangement is applicable for dosage with drops 161 into the medium stream 114. FIG. 28 shows a radial multiple orifice 163 in flow and counterflow position for excellent mixing of the additives with the medium in an enlarged medium channel 114 which causes additional mixing by change of velocity. FIG. 29 shows a continuous string introduction 164 into the medium channel. This method is able to process axial distributed material of different properties due to the injected additives.

Figure 30:
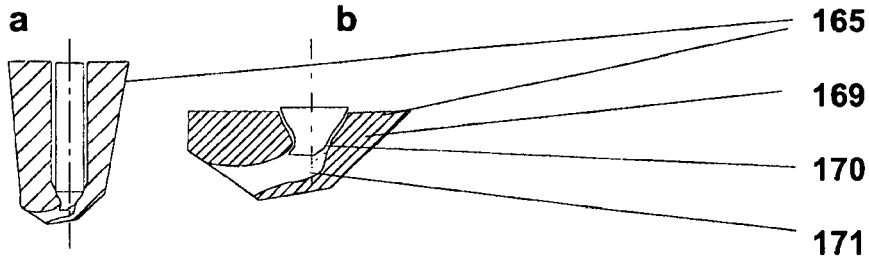
FIGS. 30, 31 and 32 are also depictions of nozzle configurations with orifice views designated by "b"
Figure 31:
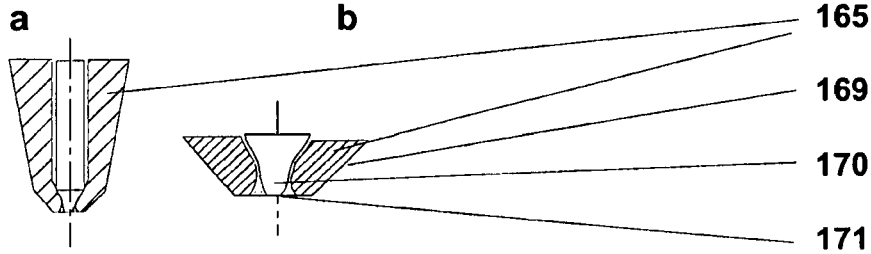
Figure 32:
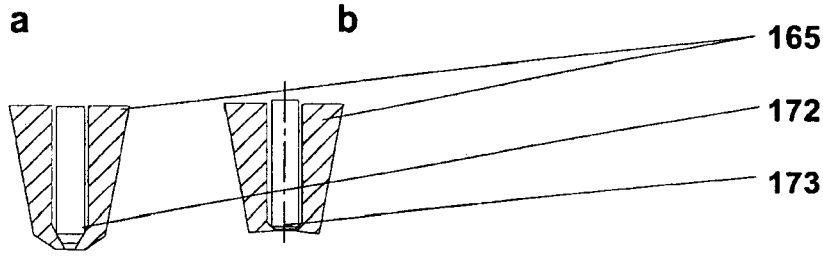
Figure 33:
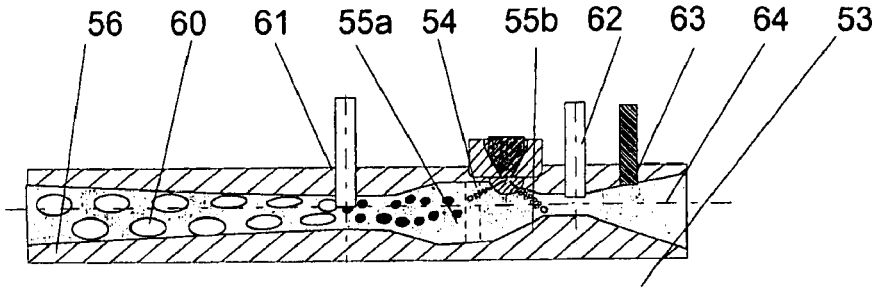
FIG. 33 is a schematic elevation view depicting the device compounding a flowing stream.

FIGS. 30, 31 and 32 show a nozzle with various orifices. FIG. 30 shows state of the art. FIG. 30*a* shows a VCO valve cone orifice. FIG. 30*b* shows radial multiple orifices. FIG. 30*c* shows pocket hole orifices. FIG. 31 shows a nozzle for flow and counterflow introduction. For introduction of additives as drops into the melt, the nozzle is designed according to hydrodynamic principles. In order to prevent atomizing, sharp edges have to be avoided. The channel profile of FIG. 32 has smooth profiles in valve cone 170 and at the nozzle profiles 171. FIG. 31 shows a nozzle introducing drops sidewise in flow direction. FIG. 33 shows a nozzle for atomizing in the conical seat 172 and plane seat 173 perpendicular to the flow direction.

Figure 34:
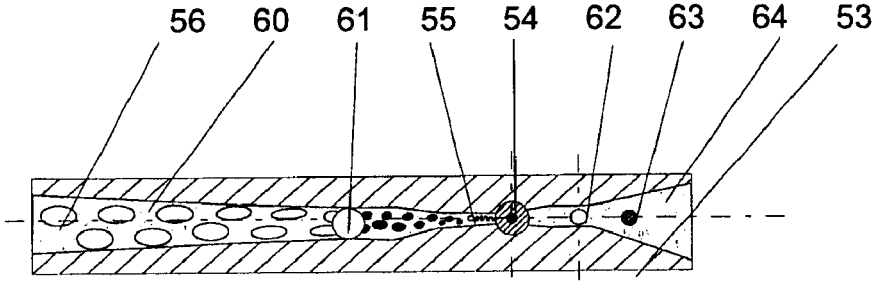
FIG. 34 is a schematic representation of a plan view of the arrangement shown in FIG. 33.

FIG. 34 shows a detail of the device for compounding a melt stream. This version is implemented in calipers 53 of profile molds 51 or for array assembly for molds to produce sheets. The section is showing details of FIGS. 13 and 14. The view shows the material flow from right to left. The caliber 53 at the inlet side 64 is conically shaped. The inlet is provided with a pressure sensor 63 that is connected to the controller 62 to supply data thereto.

The introduction of additives to the medium may be in the flow direction 55*b* or in the counterflow directions 55*a*. The advantage of the counterflow is the introduction of individually closed dosages. The introduction may optionally be caused by pulsation. Also, use may be made of chicanes (i.e. obstacles) in the flow of the medium so that the change of velocity leads to shear forces and to additional mixing respectively in the expansion zone 60.

Figure 35:
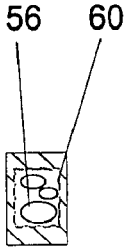
FIGS. 35 and 36 are cross-sectioned views of the outlet and inlet, respectively, of the arrangement shown in FIGS. 33 and 34 illustrating the condition of the flowing media therein.

FIG. 35 shows the top view of FIG. 34 and the relevant reference characters are the same. Note the narrow section in the medium channel.

Figure 36:
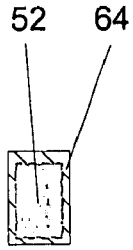

In FIGS. 36*a* and 36*b*, the section of the inlet and outlet is shown related to the device in FIGS. 34 and 35 FIG. 36*b* shows the inlet in a sectional view.

Figure 37A:
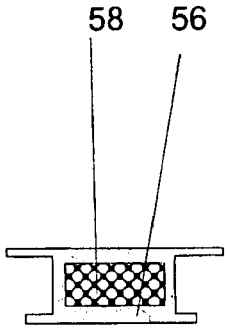
FIGS. 37*a* and 37*b* are schematic view of the outlet and inlet, respectively, of the nozzle disclosed in FIG. 33.
Figure 37B:
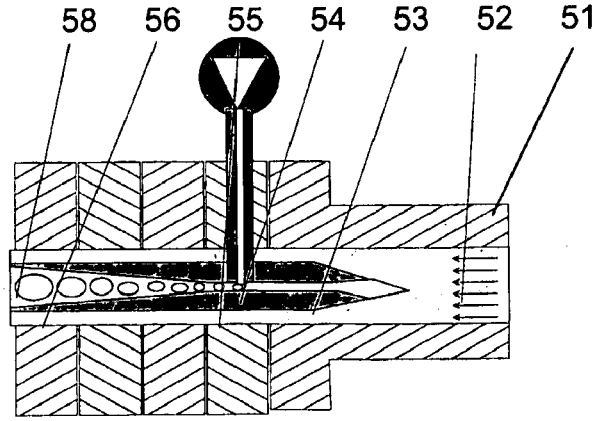

FIGS. 37*a* and 37*b* show the version of the invention as it is in FIGS. 33*a* and 33*b* but for section of differentiated medium. Reference numbers are the same as in FIG. 33.

Figure 38:
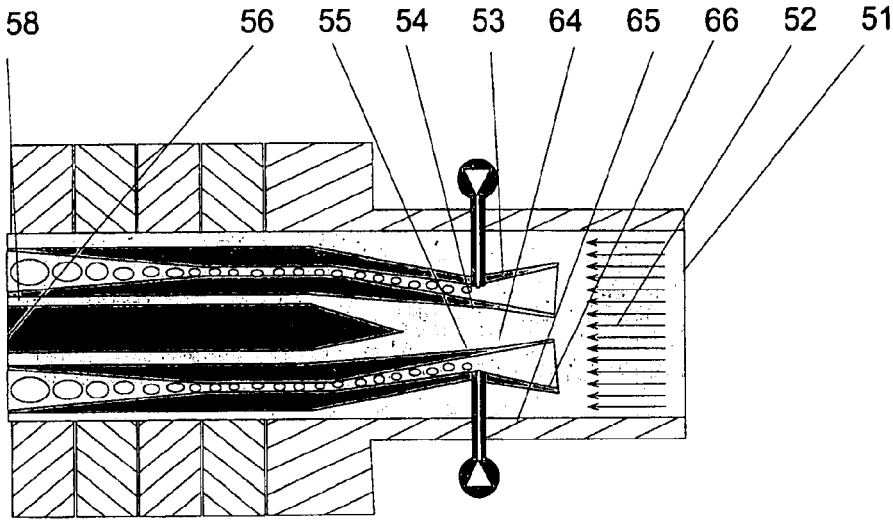
FIG. 38 is a schematic elevation view of a flowing media chamber.

FIG. 38 shows a version of medium channel before the distribution chamber of the mould. Two inlet cones 64, 65 and the center inlets 66 provide a twin chamber to the medium.

Figure 39:
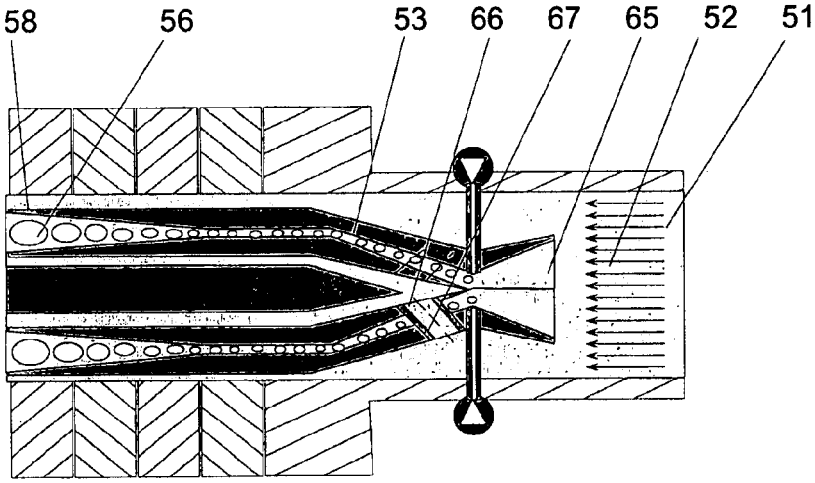
FIG. 39 is a schematic elevation view of a flowing media chamber similar to FIG. 38.

FIG. 39 shows a version of melt channel design with central inlet of the side channel and a concentrically (twin) introduction of additives and subsequent merging of the medium at spatially predetermined locations of the sectional differentiated medium property profile. The medium channel crosses the main channel 67 in the center of the surrounded flow.

Figure 40A:
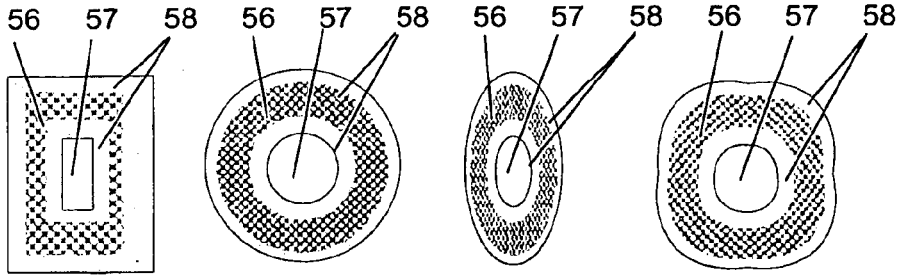

FIG. 40*a* shows a rectangular profile. FIG. 40*b* shows a circle, tubular profile. FIG. 40*c* shows an elliptical profile and FIG. 40*d* shows a rounded rectangular profile. Several profile shapes with multiple components are shown for instance in FIGS. 33, 38, 39 and 41 as being produced as simple tubular profiles.

Figure 41:
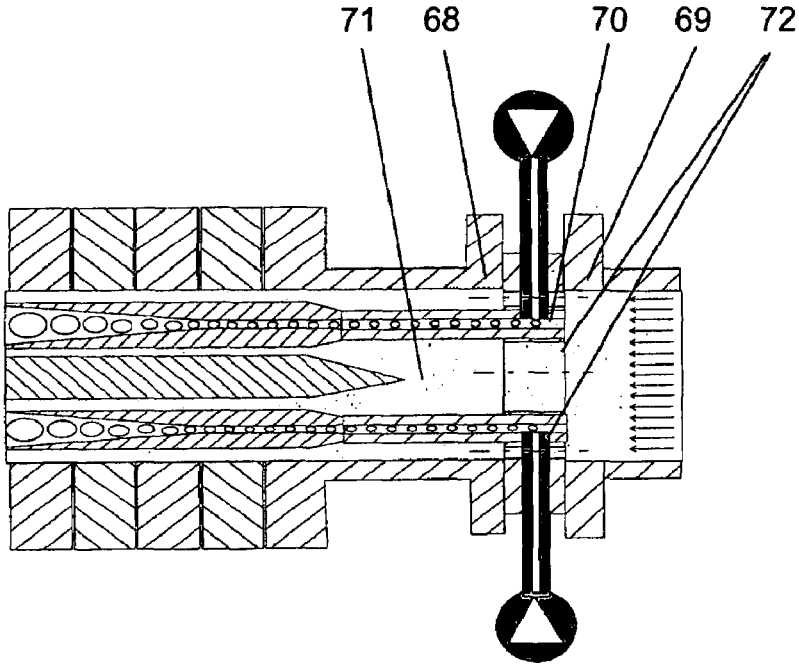
FIG. 41 is a schematic elevation view of the flowing media channel similar to that shown, for example, in FIGS. 38 and 39.

FIG. 41 illustrates a device with an add on for an existing medium channel system and can be modified for multi-component operation. For reference, the medium channel has a flange 68 and the channel system has a flange 69 between which the interface part 70 for adding on is positioned in the medium channel 71 with through put.

Figure 42:
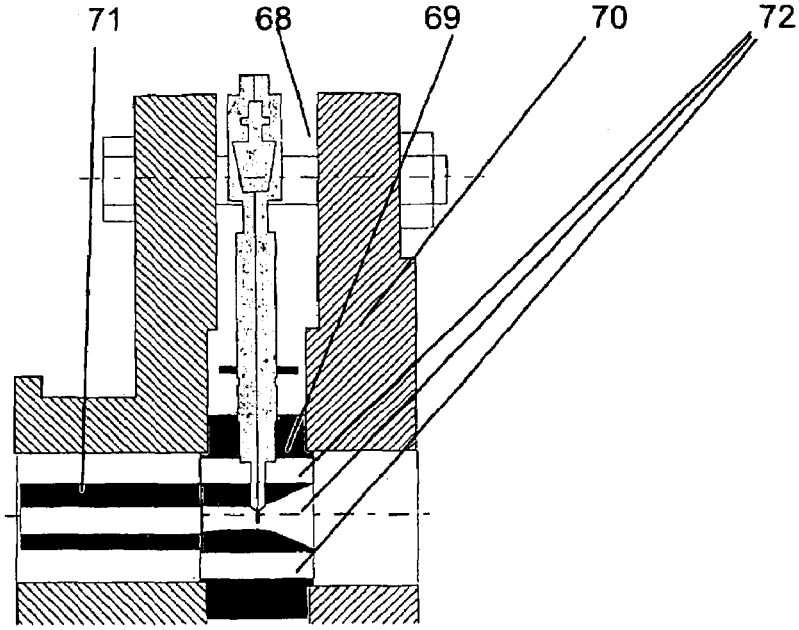
FIG. 42 is an enlarged view of the injector used in the flowing media channel shown in FIG. 41.

FIG. 42 shows the interface part 70 in FIG. 41 in detail. The interface part 70 is constructed as a disc 70 that is attached between the flanges 68 and 69. The disc 70 has injectors for introduction of the additives as well as diaphragms 72 to divert the medium channel. The tube 72 with attached planes for the hollow calipers is shown in principle.

In FIGS. 43 to 46, mixing head valves for injection systems are shown.

Figure 44:
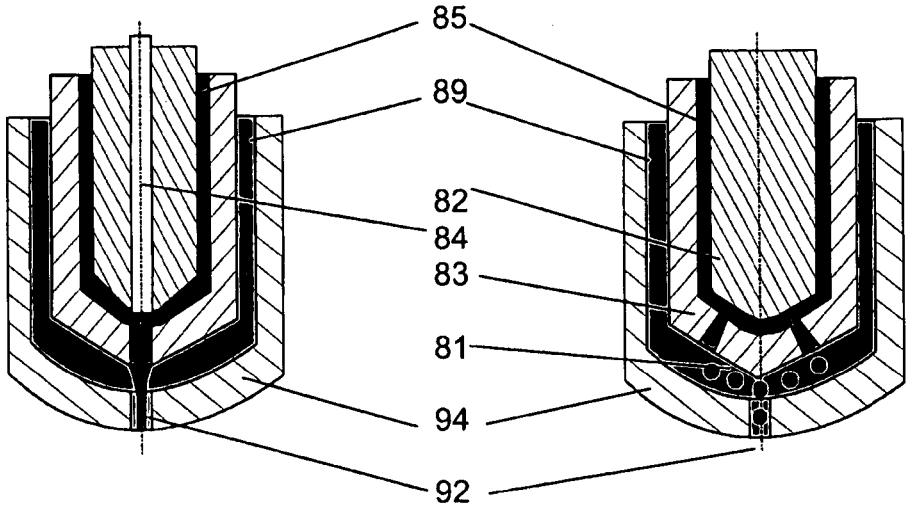
Prior Art FIG.: 44
FIG. 44 is a view of the orifice of the mixing head valve shown in FIG. 43 in greater detail with the nozzle/orifice arrangement of the present invention depicted on the right side of the drawing and prior art injector nozzle arrangement shown on the left side of the drawing.

In FIG. 44, a device in accordance with the invention is compared to a state of art device.

Figure 45A:
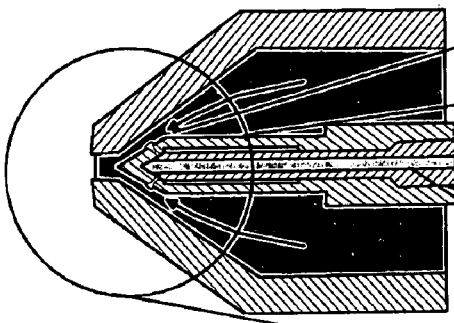
FIGS. 45*a*, 45*b* and 45*c* schematically depict, respectively, progressively closing positions of the needle valve used in the subject invention.
Figure 46A:
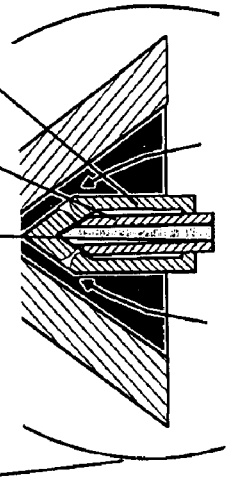
FIGS. 46*a*, 46*b* and 46*c* represent enlarged views of the orifice/needle shown in FIGS. 45*a*, 45*b* and 45*c*, respectively.
Figure 45B:
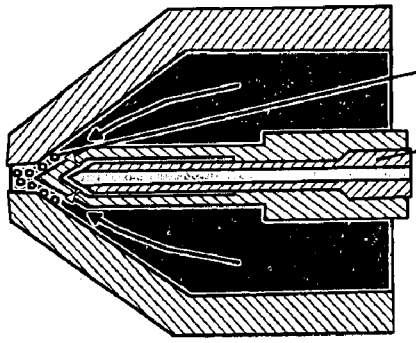
Figure 46B:
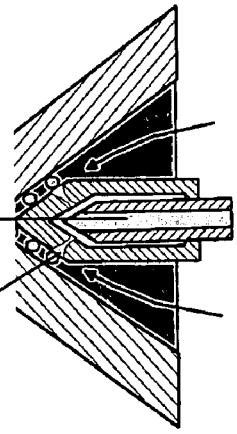
Figure 45C:
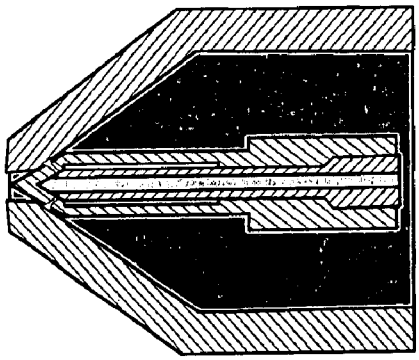
Figure 46C:
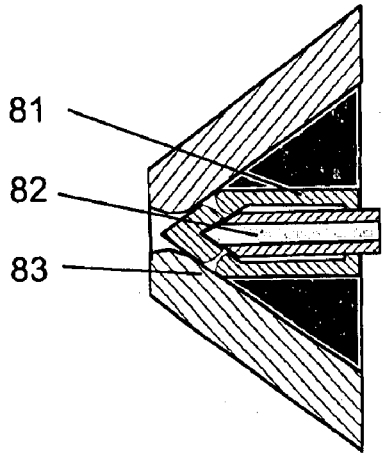

FIGS. 45A to 45C show the progressive activation of the needle tip and FIGS. 46A to 46C correspond to FIGS. 45A to 45C, respectively, and show the needle tip in detail.

Figure 47:
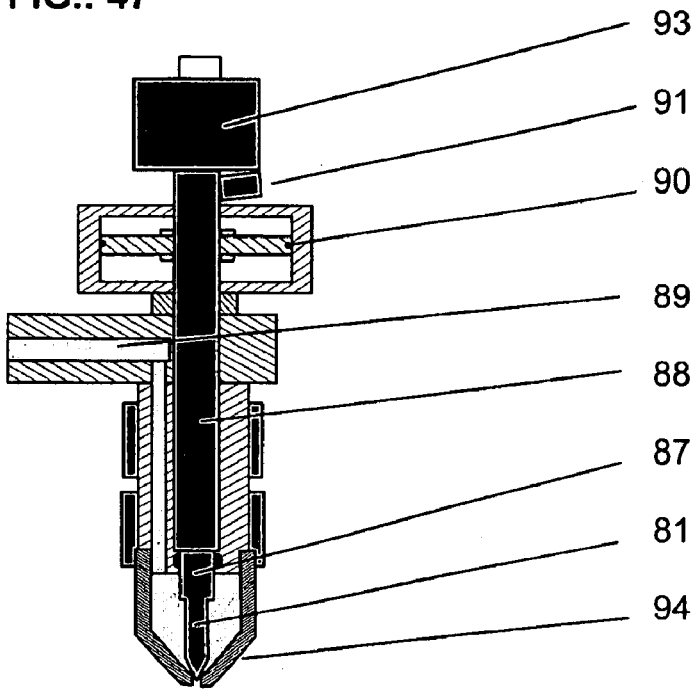
FIGS. 47 and 48 are schematic elevation representations of an injector in the mixing head valve.

FIG. 47 shows the version of the invention with high frequency pulsing (CDI Injector).

Figure 48:
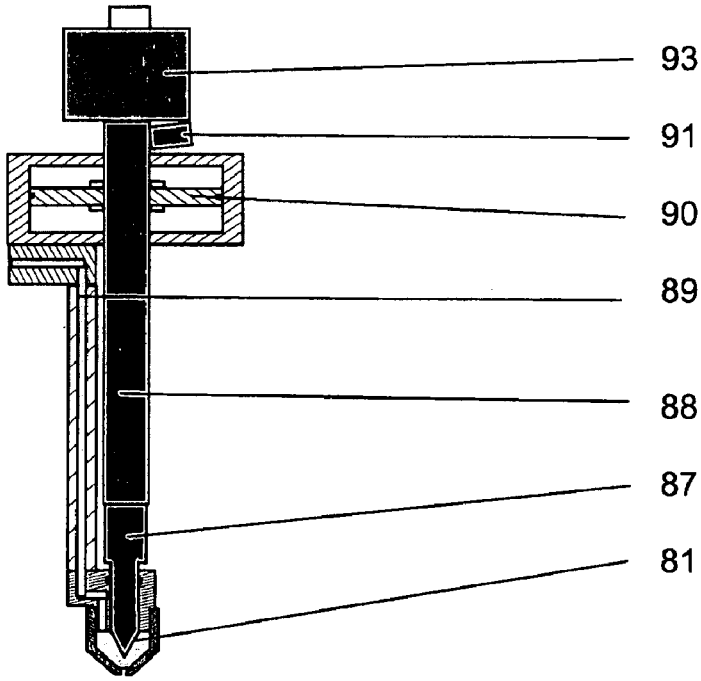

FIG. 48 shows the integration of CDI Injectors in the mixing head valve.

Figure 49:
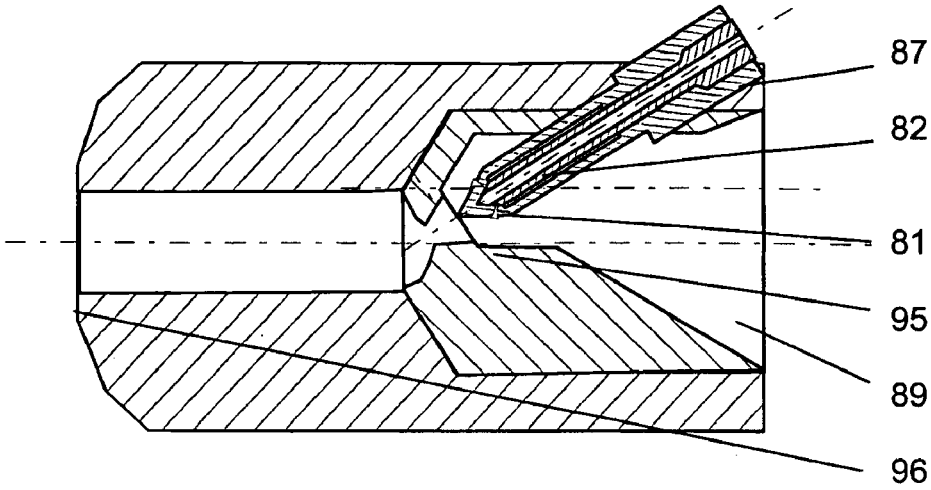
FIGS. 49 and 50 are elevation schematic cross-sectioned views of the injector applied to specific flowing media channels.

FIG. 49 shows the arrangement of a mixing and dosing head for example in the medium channel.

Figure 50:
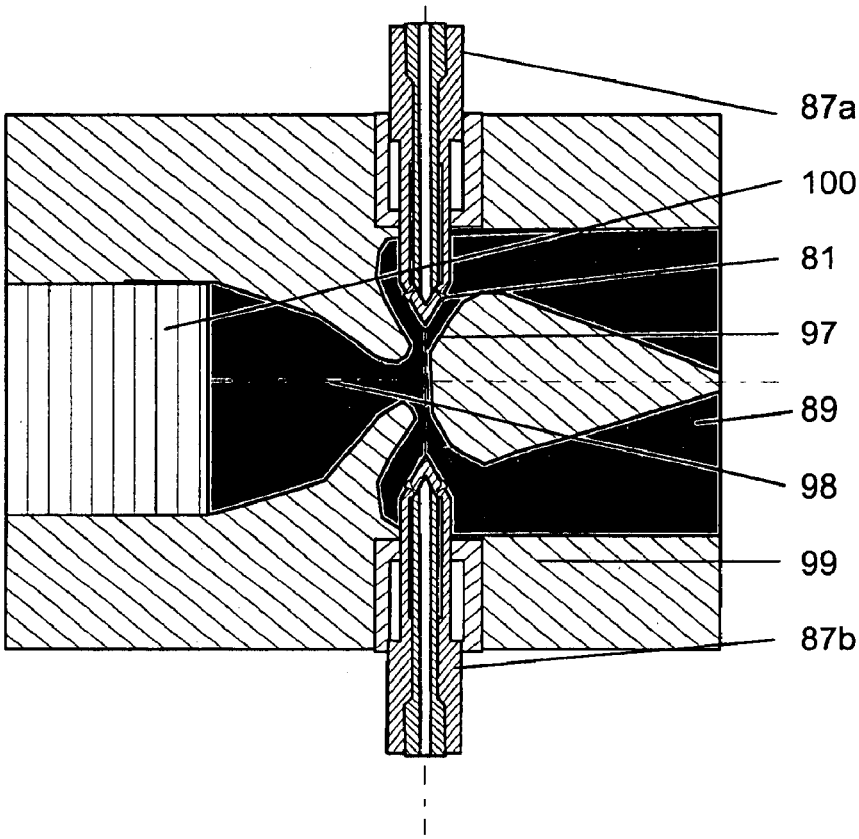

FIG. 50 shows an arrangement of a twin unit in counter-flow used for liquid/liquid mixing as well as for channel systems with a subsequent static mixer.

Figure 43:
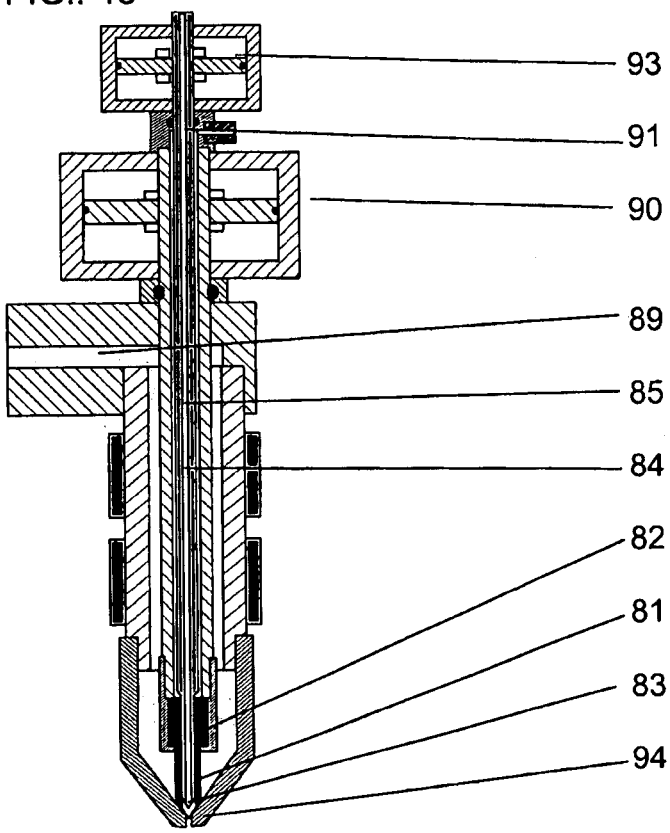
FIG. 43 is an elevation view of a mixing head valve.

FIG. 43 shows a device for mixing and dosing and dosage. The inner nozzle needle 82 is activated by the adjusting device 93 and is in the shape of the seat 83 for a pocket hole orifice or a valve cone orifice. This insert also is part of the outer nozzle needle and shaped to be attached to the actuator piston 90. The supply of the additive is made through the boring 85 and is again attached to the interface 91. The viscous medium is supplied by the channel 89 and passes between the outer nozzle 81 and the supply tube 94, for instance a mixing head.

In FIG. 44, the nozzle ("Prior Art") shows the version of a conventional inner nozzle needle as a push rod 84, as well as the inner nozzle seat, as well as the outer nozzle 94, or both according to the position of the push rod 84 for opening or locking. The outer nozzle needle is moved and regulated according to the supply of the outer medium. In FIG. 44, the present device is shown and has a nozzle insert 83 shown as a valve cone (VCO). The orifices of the inner nozzle 83 are completely covered when inside needle 82 is locked. The inner substance is supplied between the nozzle needle 82 and the valve cone orifice 83 and is introduced in the inlet to the outer medium 89. According to the position of the inner nozzle 82 and the pulsation, the atomizing of the introduced substance 85 into the outer medium 89 occurs. The conical shaped outer nozzle needle 83, being at the same function for the inner nozzle needle is locking the orifices of the nozzle seat of the hot runner 94 of the plasticizing unit 95 or of the melt channel of an 97, and regulates the opening according to the demanded volume flow and the introduction of the two media 92.

In FIG. 45A, the open position for introducing the outer medium is shown. The outer nozzle needle 81 is open. The inner nozzle 82 is closed. The substance 85 cannot penetrate. In FIG. 45B, the inner nozzle needle 82 is open and gives space for the valve cone orifices 83 and the inner substance 85 is introduced to the outer medium 92. In FIG. 45C the inner nozzle needle 82, as well as the outer nozzle needle 83 is closed.

FIGS. 46A, 46B, 46C correspond to FIGS. 45A, 45B, 45C but show enlarged details.

FIG. 47 shows the combination of a CDI injector 88 in a nozzle seat as cone valve/pocket hole nozzle 87, having the function of the nozzle needle in the needle seat of the medium channel and closing the valve seat of the mixing head valve 94. The CDI injector is activated by the position device 93. The inner nozzle needle is activated by a solenoid/hydraulic or a piezo/hydraulic servo.

The supply of the substance occurs through the fitting 91. The medium is supplied by the channel 89.

FIG. 48 shows details of FIG. 46 and differs by the medium channel 89 attached as a separate insert 87.

FIG. 49 shows the arrangement of a mixing and dosing head 95 inside the nozzle tip injection system. The insert 87 extends into the mixing head 95 and the outer nozzle 81 and at the same time as the insert 87 regulates the flow of the medium 89.

FIG. 50 shows the dosing and mixing head 98 in a tube, for instance in a tube as liquid/liquid mixer of a medium channel of a channel system 99. The inserts 87*a*, 87*b* extend into the conical nozzle seat of the mixer and modify the outer nozzle needle 81 according to the position of the volume flow of the medium 89. The supply occurs via a charging device 97 directing the medium into the conical valve seat. The additional mixing occurs by arranging the mixing heads in a counter flow to have counter impact on the media flow. Optionally, this arrangement can have four media which can be mixed together. Optionally, a static mixer can be attached subsequent to the mixing and dosing device.

The invention thus provides an apparatus that can be readily used in burner and injection arrangements. The nozzle needle of at least one nozzle respectively is variable and highly precisely moved for the introduction by means of a device and in such a way that an additive is dosed exactly in relation to the volume flow of the medium and that a pulsating stream is injected into the medium flowing past the pulsating stream, by means of at least one well-aimed nozzle opening. The additives are dosed by means of a pressure that can be variably adjusted such as by pulse width and pulse frequency. The desired homogenous (AREOSOL) distribution is obtained by the penetrating injection jet during compounding for instance.

Indexing of reference numbers:

1. Nozzle needle precisely moved
2. Nozzle body
3. Nozzle needle seat
4. Plane plurality of orifice arrangement
5. Cavity at valve cone orifice VCO
6. Radial plurality of orifice arrangement
7. Axial boring in nozzle body
8. Cavity at valve sack orifice
9. High pressure pump
10.l Channel of streaming medium
11. Injector
12. High pressure piping
13. Leakage backflow piping
14. Container of additives
15. Common rail (communication system)
16. Cellular pump
17. Streaming medium
18. Injection spray stream
19. Feeding unit barrel
20. Dosing chamber of barrel of injection molding machines
21. Nozzle of barrel
22. Mould
23. Hot runner system
30. Inner rod (caliber) of extrusion mould
31. Section of extruded profile
32. Inner rod (caliber) for hollow section
33. Foamed inner section
34. Hollow section
35. Extruded profile
36. Cascade shaped injection
37. Radial plurality of orifice arrangement for extrusion
38. Core of the mould
39. Jet streaming combustion air
40. Screw of plasticizing unit
41. Expansion zone in the extrusion mould, preferable situated in the inner rod of the mould
51. Mould for production of profiles by extrusion
52. Melt stream, feeding of melt from extruder to the mould
53. Caliber inside the melt stream section, implementation for the mould to conduct the melt stream, particular with an integrated melt channel.
54. Injector, nozzle for introducing of additives into the separately arranged melt channel.
55. Introduction of additives
55a. Introduction in flow direction
55b. Introduction in counter flow
56. Outlet section of separately arranged melt channel.
57. Caliber inner rod for forming a hollow section and hollow profile.
58. Melt channel with original shaped extruded profile and the corresponding section.
59. High pressure pump for additives.
60. Zone of expansion for the introduced gas creating additives.
61. Adjustable section for controlled outflow, chicane for mixing
621. Adjustable section for controlled inflow.
63. Pressure sensoring cell for the separately arranged melt stream as indicator.
64. Caliber inner rod with melt channel and inlet opening.
65. Tubular inlet section for multiple shell arrangement for extrusion profiles.
66. Central inlet opening for the inner shell of the extrusion profile.
67. Intersecting melt duct, passing through main melt stream.
68. Flange of the mould
69. Flange of the extruder
70. Intermediate add up equipment
71. Extension of the melt stream channel
72. Intersection through the melt stream channel
81. Melt medium nozzle needle outside
82. Additive nozzle needle inside
83. Coaxial conical needle seat
84. Bolt in boring to activate the additive nozzle needle
85. Supply of additives to the boring
86. Details of mixing and dosing device
87. Valve cone orifice, Pocket hole orifice -continued Indexing of reference numbers:

88. Common rail injector (CDI injector)
89. Supply channel for melt stream
90. Activator piston by hydraulics
91. Supply of the additives
92. Introduction of additives to the melt
93. Servo-mechanics for instance electro/hydraulic, piezo/hydraulic
94. Hot runner nozzle seat
95. Injection Molding nozzle seat
96. Injection Molding feeding unit nozzle
97. Extrusion nozzle seat
98. Supply device
99. Melt channel for extruders
100. Statical mixer
101. Feeding device for gas creators
102. Pressure controller for gas C. p1
103. Circuit for gas creator substance
104. Hydraulic circuit for activation
105. Feeding device for hydraulic circuit
106. Pressure control for hydraulic c. p2
107. Tank for hydraulic oil
108. Spheres for valve
109. Solenoid or piezo activator device
110. Hydraulic activation of the valve
111. Back pressure, seal
112. Valve for the injector
113. Nozzle of injector
114. Gate of the melt stream
115. Pressure sensor-cell in melt stream
116. Adapting device between the runner
117. Introduction of additives to the melt
118. Heater band of the adapting device
119. Pressure control for additives p3
120. Arbitrary Wave Form Generator
121. Pressure controller for additives
122. Controller
123. Interface to metal injection machine, extruder, die-casting
124. Pump-nozzle combination
125. Leakage piping
126. Supply piping for hydraulic
127. Anchor for solenoid activation
128. Injector
129. Throttle valve
130. Valve push rod
131. Spring for clamping
132. Feeder piping for gas creator
133. Additional channel for $2^{nd}$ medium
134. Stopping device f. strokelimitation
135. Pump push rod
136. Feeding pipeline valve
137. Feeding pipeline for sphere valve
138. Reverse motion spring 18
139. Backpressure valve on melt end
140. Leakage pipeline
141. Shrinkage of sphere seat
142. Hydraulic system of basic machine
143. Pressure multiplier piston additive
144. Pressure multiplier piston hydraulics
145. Axis for force in MPa
146. P1 pressure of additive
147. P2 pressure of hydraulic
148. P3 pressure of melt
149. P5 pressure on control piston
150. Axis of time
151. Current supply to solenoid
152. Center line
153. Trapezoid wave shape
154. Triangle wave shape
155. Half sinus wave
156. Full sinus wave
157. Periodic wave form
158. Unsymmetrical full sinus wave
159. Heater band for injector
160. Injector
161. Introduction in flow direction
162. Adaptation to the mould -continued

| Indexing of reference numbers: | |
|---|---|
| 163. | Spraying in melt flow/counter melt flow |
| 164. | Volume enlargement after continuous introducing of additives |
| 165. | Nozzle body |
| 166. | Slot shaped nozzle |
| 167. | Radial shaped nozzle borings |
| 168. | Valve cone orifice |
| 169. | Enlarged Laval channel |
| 170. | Nozzle needle open |
| 171. | Channel of nozzle |
| 171. | Valve cone orifice nozzle channel |
| 172. | Conical nozzle needle, axial spray |

What is claimed is:

1. A method for introducing additives into flowing fluid media comprising the steps of directing a flow of combustion gas in a predetermined path; and spraying fuel into said stream under a high pressure and in a pulsating manner and in a dosed amount in relation to the volume stream of said fluid media to effect penetration of the fuel into said stream of fluid media while maintaining high kinetic and pulse energy to obtain a homogenous mixture of the combustion gas and fuel.

2. A method for introducing additives into flowing fluid media comprising the steps of directing a flow of cellulose in a predetermined path; and spraying at least one additive selected from the group consisting of a bleaching agent, solvent and blowing agent into said flow of cellulose under a high pressure and in a pulsating manner and in a dosed amount in relation to the volume stream of said flow of cellulose to effect penetration of the additive into said flow of cellulose while maintaining high kinetic and pulse energy to obtain a homogenous mixture of the flow of cellulose and additive.

3. A method for introducing additives into flowing fluid media comprising the steps of directing a flow of gas in a predetermined path; and spraying at least one additive selected from the group consisting of a dye and a solvent into said flow of gas under a high pressure and in a pulsating manner and in a dosed amount in relation to the volume stream of said flow of gas to effect penetration of the additive into said flow of gas while maintaining high kinetic and pulse energy to obtain a homogenous mixture of the flow of gas and additive.

4. Apparatus for introducing at least one additive into a fluid media stream comprising a channel for directing a stream of fluid media in a predetermined path;

an injector extending into said channel for spraying at least one additive into said stream under a high pressure; and means for opening and closing said injector for delivery of the additive in a pulsating manner and in a dosed amount in relation to the volume stream of said fluid media to effect penetration of the additive into said stream of fluid media while maintaining high kinetic and pulse energy to obtain a homogenous mixture of the fluid media and additive.

5. Apparatus as set forth in claim 4 wherein said channel is a combustion chamber and said fluid media is a combustion air stream and wherein said injector has at least one orifice located on a cone with an opening angle between 20° and 80° and extending into said combustion air stream and said additive is a fuel.

6. Apparatus as set forth in claim 4 further comprising a plurality of said injectors, each said injector having a plurality of orifices with at least one orifice in the direction of the axis of said injector.

7. Apparatus as set forth in claim 4 further comprising a first pump having a line connected to said injector for supplying additive under pressure thereto, a second pump having a hydraulic line connected to said injector for supplying hydraulic fluid thereto, a controllable pressure limit valve connected to each said line for controlling the pressure therein, a pressure sensor in said channel for the flowing medium, a pressure sensor in said hydraulic line, a pressure sensor in said line for supplying additive, and a controller connected to said pressure limit valve to maintain a constant differential pressure between said line for supplying additive and said channel and between said line for supplying additive and said hydraulic line in dependence on signals from said sensors.

8. Apparatus for introducing at least one additive into a metal melt media stream comprising a channel for directing a stream of metal melt in a predetermined path;

a core within said channel having a plurality of passages for directing said stream into a predetermined profile, at least one of said passages having a conically shaped expansion zone therein; and an injector extending into said core and communication with said one passage for spraying at least one additive into said stream passing therethrough under a high pressure upstream of said expansion zone.

9. Apparatus for manufacturing extruded profiles of different plastic components comprising a channel having at least two melt channels;

an injector extending into at least one of said melt channels for introducing additives into the melt stream;

a pressure sensor located in the melt stream for sensing the pressure of the melt stream;

a regulator connected to said sensor and said injector for adjusting the pressure of the additives in response to the pressure of the melt stream;

a device for pulsating the introduction of the additives into the melt stream;

a mixer in the melt stream downstream of said injector for mixing the melt and the additives;

a junction to unify the melt streams of said melt channels to one stream; and a mold downstream of said junction to receive said one stream for creating a profile consisting of different material components melted together in the mold.

10. Apparatus as set forth in claim 9 further comprising an extruder having a flange, a tool having a flange and wherein said injector is mounted between said flange of said extruder and said flange of said tool.

* * * * *

UNITED STATES PATENT AND TRADEMARK OFFICE

CERTIFICATE OF CORRECTION

PATENT NO. : 7,347,886 B2
APPLICATION NO. : 11/491222
DATED : March 25, 2008
INVENTOR(S) : Georg Michael Ickinger It is certified that error appears in the above-identified patent and that said Letters Patent is hereby corrected as shown below:

Column 14
Line 37, change "and" to -- in --

Signed and Sealed this

Twenty-fourth Day of June, 2008

JON W. DUDAS
*Director of the United States Patent and Trademark Office*